US010916368B2

(12) United States Patent
Park et al.

(10) Patent No.: US 10,916,368 B2
(45) Date of Patent: Feb. 9, 2021

(54) BOBBIN AND COIL ASSEMBLY AND ELECTROMAGNET EQUIPMENT INCLUDING SAME

(71) Applicant: KOREA BASIC SCIENCE INSTITUTE, Daejeon (KR)

(72) Inventors: Seung-Young Park, Daejeon (KR); Jungmin Park, Daejeon (KR)

(73) Assignee: KOREA BASIC SCIENCE INSTITUTE

( * ) Notice: Subject to any disclaimer, the term of this patent is extended or adjusted under 35 U.S.C. 154(b) by 160 days.

(21) Appl. No.: 16/152,568

(22) Filed: Oct. 5, 2018

(65) Prior Publication Data

US 2019/0115144 A1 Apr. 18, 2019

(30) Foreign Application Priority Data

Oct. 12, 2017 (KR) ..... 10-2017-0132641

(51) Int. Cl.

| | |
|---|---|
| ***H01F 3/00*** | (2006.01) |
| ***H01F 27/28*** | (2006.01) |
| ***H01F 7/20*** | (2006.01) |
| ***H01F 27/24*** | (2006.01) |
| ***H01F 27/10*** | (2006.01) |
| ***H01F 27/02*** | (2006.01) |
| ***H01F 27/32*** | (2006.01) |

(52) U.S. Cl.

CPC ..... *H01F 27/2876* (2013.01); *H01F 7/202* (2013.01); *H01F 27/02* (2013.01); *H01F 27/10* (2013.01); *H01F 27/24* (2013.01); *H01F 27/2885* (2013.01); *H01F 27/325* (2013.01)

(58) Field of Classification Search

CPC ..... H01F 27/02; H01F 27/10; H01F 27/202; H01F 27/24; H01F 27/2876; H01F 27/2885; H01F 27/325

USPC ..... 335/297

See application file for complete search history.

(56) References Cited

U.S. PATENT DOCUMENTS 1,899,036 A * 2/1933 Hulse ..... F25D 11/003 62/180
1,899,341 A * 2/1933 Lipman ..... F25B 31/006 62/204

(Continued)

FOREIGN PATENT DOCUMENTS

JP S6320808 A 1/1988
JP H01293602 A 11/1989

(Continued)

*Primary Examiner* — Shawki S Ismail
*Assistant Examiner* — Lisa N Homza
(74) *Attorney, Agent, or Firm* — Mendelsohn Dunleavy P.C.

(57) ABSTRACT

The present invention relates to a bobbin and a coil assembly and electromagnet equipment including the same, and the electromagnet equipment, which includes a bobbin and a coil, includes a coil assembly receiving a refrigerant so as to remove heat produced when magnetic field lines are formed by an electric current running through the coil while the coil is wound on a center shaft relative to the center shaft provided on a center of the bobbin; and a terminal block provided on a lower side of the coil assembly, the terminal block supporting the coil assembly and receiving a refrigerant from outside and supplying the refrigerant to the coil assembly.

24 Claims, 8 Drawing Sheets

(56) References Cited

U.S. PATENT DOCUMENTS 2,482,220 A * 9/1949 Smith ..... F25D 31/002 62/394
2,669,100 A * 2/1954 Peterson ..... F25B 29/003 62/160
3,265,828 A * 8/1966 Corn ..... B23K 35/383 335/132
4,344,103 A * 8/1982 Nagamoto ..... H01H 51/24 335/133
6,337,614 B1 * 1/2002 Tsutsui ..... H01H 50/02 335/160
6,916,161 B2 * 7/2005 Brunner ..... B63J 2/04 417/362
6,975,194 B2 * 12/2005 Nishida ..... H01H 51/2209 335/132
7,023,306 B2 * 4/2006 Nishida ..... H01H 50/305 335/128
7,623,010 B2 * 11/2009 Liu ..... H01H 50/32 335/107
8,169,280 B2 * 5/2012 Saruwatari ..... H01H 51/2272 335/78
10,295,233 B2 * 5/2019 Yanase ..... F04B 39/0055
2004/0001768 A1 * 1/2004 Fujisawa ..... H02K 33/18 417/416
2004/0080389 A1 * 4/2004 Nishida ..... H01H 50/026 335/132
2008/0039331 A1 * 2/2008 Okazaki ..... H02K 55/04 505/166
2009/0243773 A1 * 10/2009 Chung ..... F16D 27/112 335/282
2009/0322453 A1 * 12/2009 Kawaguchi ..... H01F 7/1615 335/81
2010/0127594 A1 * 5/2010 Takeda ..... H02K 19/20 310/263
2010/0283564 A1 * 11/2010 Takeda ..... H02K 55/02 335/216
2011/0032061 A1 * 2/2011 Kato ..... H01H 50/44 335/297
2014/0294626 A1 * 10/2014 Aso ..... H02K 11/215 417/410.1
2015/0033787 A1 * 2/2015 Aso ..... H02K 29/08 62/467
2020/0006993 A1 * 1/2020 Yoshikawa ..... H02K 3/525

FOREIGN PATENT DOCUMENTS

JP 2010118466 A 5/2010
JP 2014504799 A 2/2014

* cited by examiner

BOBBIN AND COIL ASSEMBLY AND ELECTROMAGNET EQUIPMENT INCLUDING SAME

CROSS REFERENCE TO RELATED APPLICATION

The present application claims priority to Korean Patent Application No. 10-2017-0132641, filed Oct. 12, 2017, the entire contents of which is incorporated herein for all purposes by this reference.

BACKGROUND OF THE INVENTION

Field of the Invention

The present invention generally relates to electromagnet equipment which produces a high magnetic field. More particularly, the present invention relates to a bobbin and a coil assembly and electromagnet equipment including the same, wherein magnetic field lines or a magnetic field can be condensed.

Description of the Related Art

An electromagnet is used to obtain magnetism stronger than the magnetism of a conventional permanent magnet. Strength of the electromagnet is determined by the number of coil windings, an electric current running through a coil, and magnetic permeability of a core. Accordingly, magnetic field efficiency defined as the strength of a magnetic field to an electric current which is supplied increases as the number of coil windings increases relative to a predetermined input electric current.

However, there is limitation in simply increasing the number of coil windings so as to increase the magnetic field efficiency. That is, as the number of coil windings of the electromagnet increases, the thickness of a coil layer increases. When the thickness of the coil layer increases, it is difficult to remove heat produced at the center part of the coil, which causes overheating.

Accordingly, an excessive increase in the size of the coil layer results in overheating of the center part of the coil, thus lowering the limit of an allowable electric current that can be input to the coil. Accordingly, there is a limitation in increasing the number of coil windings to increase the magnetic field efficiency.

Accordingly, to obtain an increased magnetic field efficiency, electromagnet equipment which can sufficiently facilitate removal of heat produced by the electromagnet and condense magnetic field lines is required.

SUMMARY OF THE INVENTION

Accordingly, the present invention has been made keeping in mind the above problems occurring in the related art, and the present invention is intended to propose a bobbin and a coil assembly and electromagnet equipment including the same, wherein magnetic field lines can be condensed.

In order to achieve the above object, according to embodiments of the present invention, there is provided electromagnet equipment including a bobbin and a coil, the electromagnet equipment including: a coil assembly receiving a refrigerant so as to remove heat produced when magnetic field lines are formed by an electric current running through the coil while the coil is wound on a center shaft relative to the center shaft provided on a center of the bobbin; and a terminal block provided on a lower side of the coil assembly, the terminal block supporting the coil assembly and receiving a refrigerant from outside and supplying the refrigerant to the coil assembly.

Here, the coil assembly may include the core hole or the core groove provided on the center shaft of the bobbin thereof, and the electromagnet equipment may further include a core rod being inserted into a core hole or a core groove and being magnetized by the electric current running through the coil so as to form the magnetic field lines.

Furthermore, the core rod may include a core pole, an upper side end of which is exposed through the core hole or the core groove to an outside, and condensing the magnetic field lines; and a core rod body provided on a lower side of the core pole and supporting the core pole.

In addition, the core rod may become equal or narrower in width to an upper side thereof from a lower side thereof.

Additionally, the electromagnet equipment may further include a ground yoke provided between the coil assembly and the terminal block so as to support the coil assembly.

Here, the ground yoke may include a through hole or a through groove arranged thereon such that a refrigerant tube guiding the flow of the refrigerant or a line of the coil passes through the ground yoke via the through hole or the through groove and is connected to the terminal block.

Furthermore, a lower side end of the core rod may be combined with and supported by the ground yoke.

Here, the electromagnet equipment may further include: a radiation shield provided on an upper side of the coil assembly so as to cover at least a portion of an upper side end of the coil assembly and to prevent heat produced from the coil assembly from being released to outside.

In addition, the electromagnet equipment may further include: a surrounding yoke covering at least a portion of the radiation shield or an outer circumferential surface of the coil assembly and guiding such that the magnetic field lines produced from the coil assembly can be condensed to a core rod.

Furthermore, the electromagnet equipment may further include a protector covering at least a portion of at least any one of the radiation shield and the surrounding yoke and absorbing impacts caused by physical contacts from outside so as to prevent accidents that may occur while magnetic materials such as a driver, a plier, a pincette or a permanent magnet that may be around the electromagnet stick rapidly to the surrounding yoke due to a strong magnetic field.

In order to achieve the above object, the coil assembly according to the embodiments of the present invention includes a coil wound so as to form magnetic field lines by using an electric current supplied from an outside; and a bobbin provided with a center shaft on which the coil is wound relative thereto, wherein a line of the coil includes a through hole provided on an inner side thereof so as to enable flow of a refrigerant supplied from outside.

In order to achieve the above object, the coil assembly according to the embodiments of the present invention includes a coil wound so as to form magnetic field lines by using an electric current supplied from outside; a bobbin provided with a center shaft on which the coil is wound relative thereto; and a cooler arranged such that at least a portion of the cooler is in contact with an inner circumferential surface or an outer circumferential surface of the coil wound relative to the center shaft of the bobbin, the cooler removing heat produced by an electric current running through the coil by using a refrigerant supplied from outside.

Furthermore, the cooler may be arranged between the coil and the bobbin and covers the inner circumferential surface of the coil.

In addition, the cooler may be arranged on the outer circumferential surface of the wound coil and covers the outer circumferential surface of the coil.

Additionally, the coil may include a first coil arranged to a core hole of the bobbin and a second coil arranged on an outer side of the cooler, with the cooler provided therebetween, wherein the first coil is arranged on an inner side of the cooler and the second coil is arranged on the outer side of the cooler, the cooler being in contact with an outer side surface of the first coil and an inner side surface of the second coil.

Furthermore, the bobbin may include a through hole or a through groove through which a refrigerant tube guiding the flow of the refrigerant by being connected to the cooler or a line of the coil passes through the bobbin and is connected to a terminal block.

In order to achieve the above object, the bobbin capable of being used by being included in constitution of the electromagnet equipment according to the embodiments of the present invention includes: a conduction part made of metal materials having high thermal conductivity; and a magnetic condensation part provided on a lower side of the conduction part by being combined with the conduction part, the magnetic condensation part being made of a ferromagnetic material.

Here, the conduction part, made of metal materials having high thermal conductivity, may be a nonmagnetic substance.

Furthermore, the conduction part may be an alloy material including any one of aluminium and copper.

In addition, the conduction part may include a conducting shaft provided on a center thereof, the conducting shaft having a core hole, and wherein the magnetic condensation part includes a condensation shaft provided on a center thereof, the condensation shaft having the core hole or a core groove, the conducting shaft of the conduction part and the condensation shaft of the magnetic condensation part being combined with each other so as to constitute a center shaft on which a coil is wound relative thereto.

Additionally, the condensation shaft of the magnetic condensation part may become narrower in width toward an upper side thereof.

Furthermore, edge provided on the upper side of the condensation shaft may have an inclination angle of 5 to 85 degree relative to a center axis of the condensation shaft.

In addition, the surroundings in which the strong magnetic field occurs are required to be careful of accidents, and there may be further provided the protector such as a buffer bumper so as to prevent accidents that may occur while magnetic materials such as a driver, a plier, a pincette or a permanent magnet that may be around the electromagnet stick rapidly to some things due to a strong magnetic field.

Here, the protector may cover at least a portion of the surrounding yoke, and may further cover a portion of the radiation shield.

According to the present invention, there is provided the bobbin and the coil assembly and the electromagnet equipment including the same, wherein the bobbin can condense the magnetic field lines, and the coil assembly and the electromagnet equipment can facilitate removal of heat produced by the coil, thereby increasing magnetic field efficiency further and preventing unexpected accidents that may be caused by a strong magnetic field.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Hereinbelow, exemplary embodiments of the present invention will be described in detail with reference to the accompanying drawings.

Figure 1A:
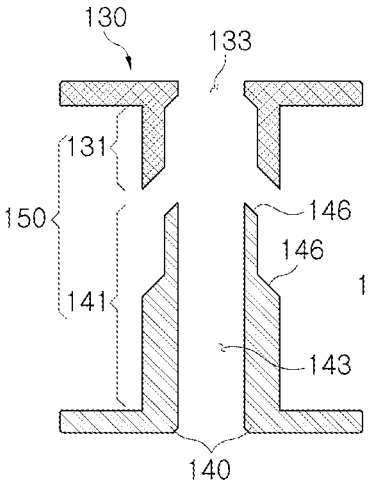
FIGS. 1A to 1C are views roughly showing a bobbin of electromagnet equipment according to a first embodiment of the present invention.
Figure 1B:
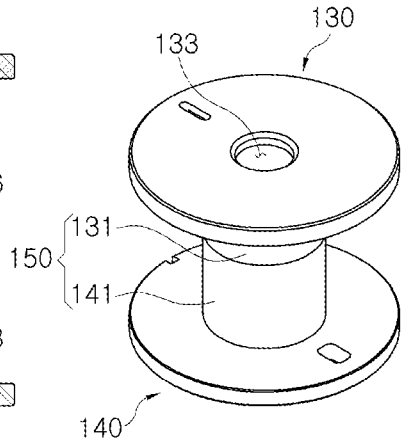
Figure 1C:
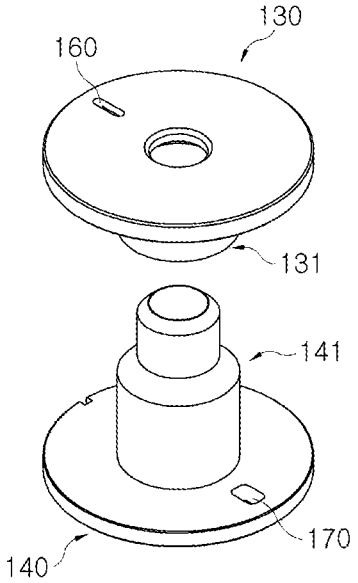
Figure 2A:
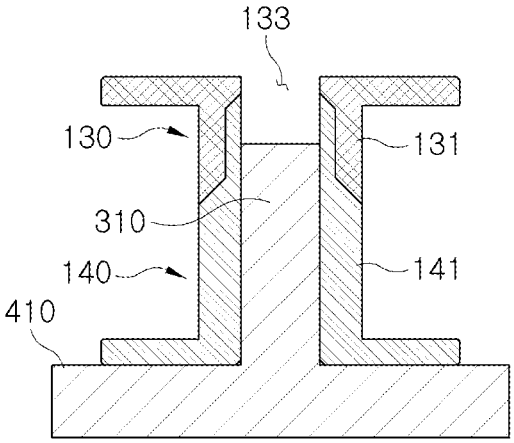
FIGS. 2A and 2B are side cross-sectional views roughly showing a side cross-section of the bobbin of the electromagnet equipment according to the first embodiment of the present invention.
Figure 2B:
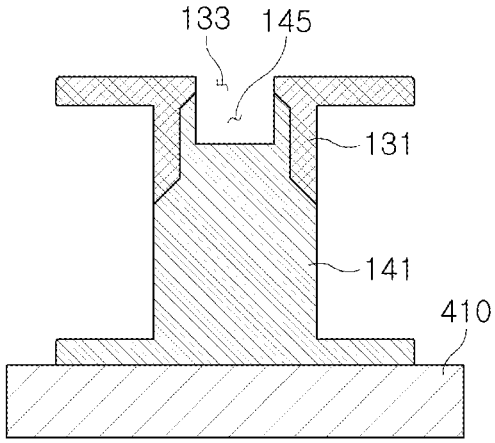
Figure 3:
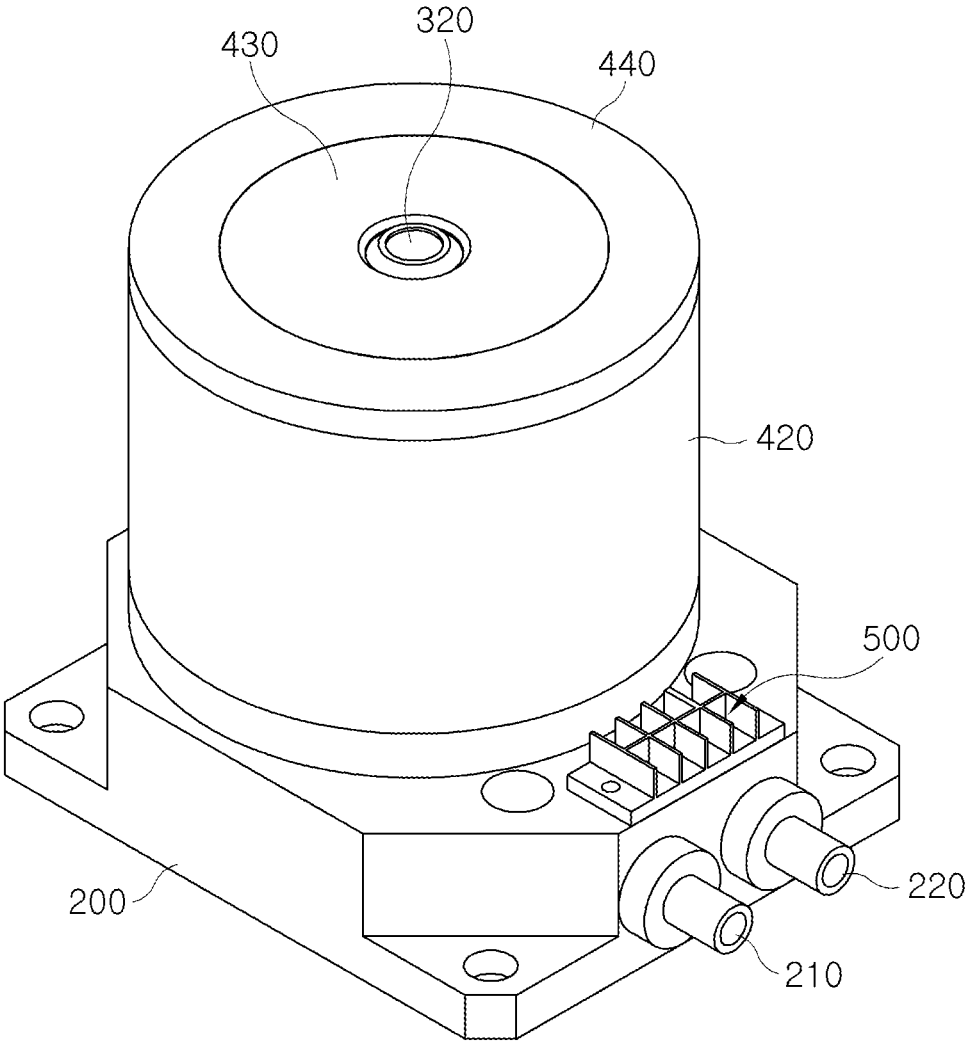
FIG. 3 is a perspective view roughly showing the electromagnet equipment according to the first embodiment of the present invention.
Figure 4:
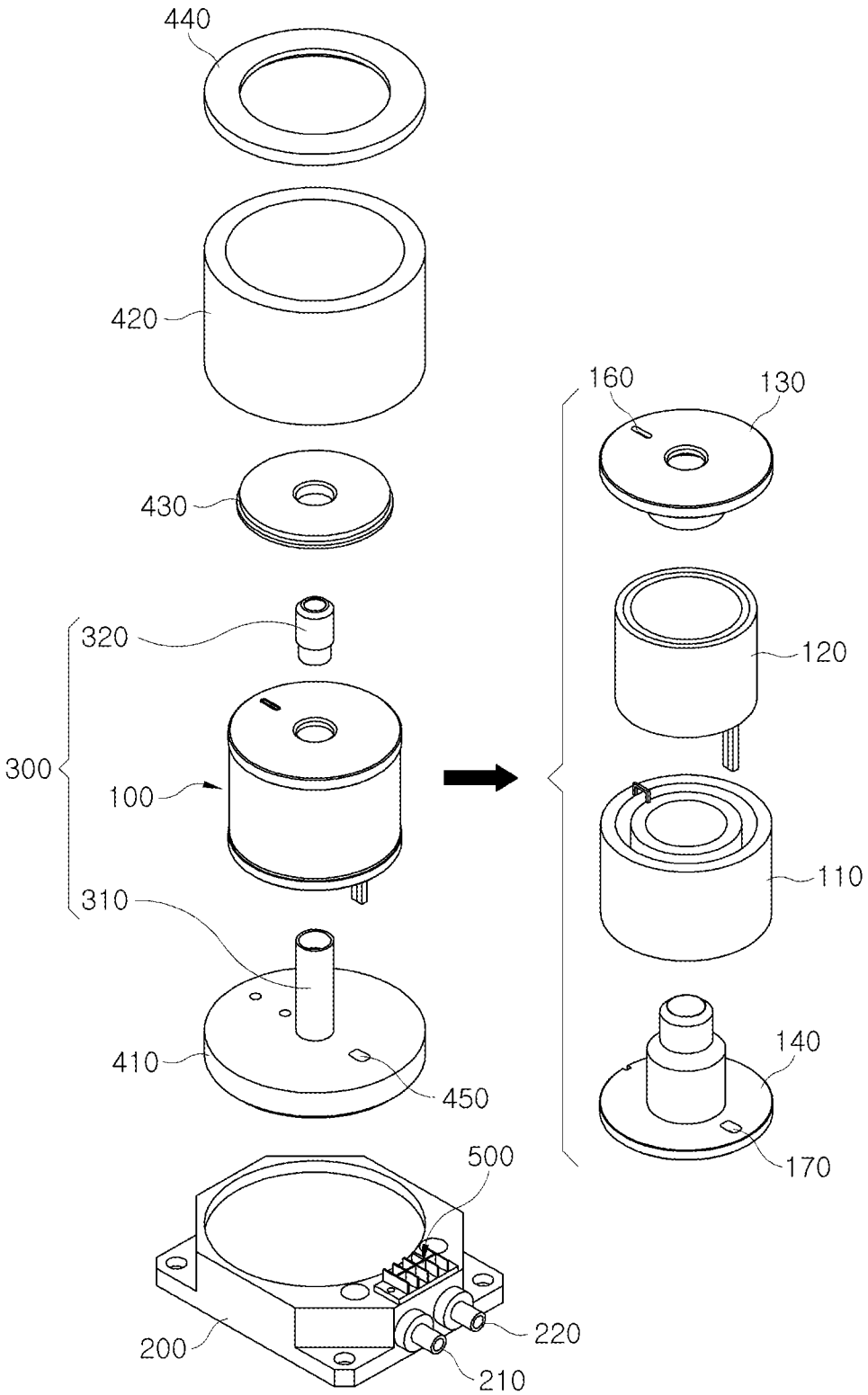
FIG. 4 is an exploded perspective view roughly showing the electromagnet equipment according to the first embodiment of the present invention.
Figure 5:
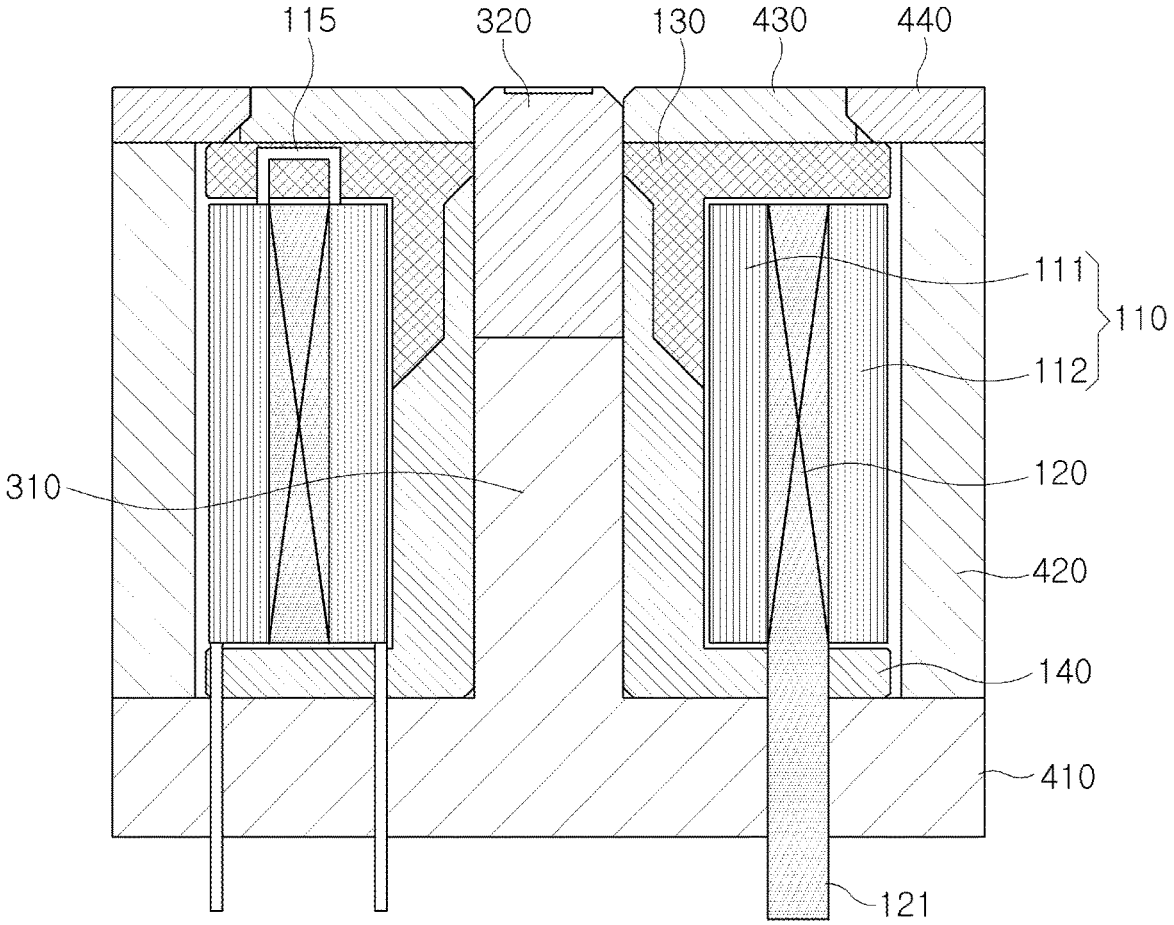
FIG. 5 is a side cross-sectional view roughly showing a side cross-section of the electromagnet equipment according to the first embodiment of the present invention.
Figure 6A:
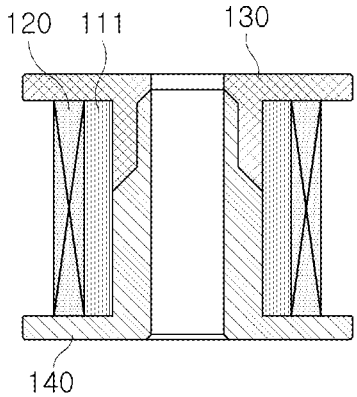
FIGS. 6A to 6C are side cross-sectional views showing various arrangements of a coil and a cooler in a coil assembly of the electromagnet equipment according to the first embodiment of the present invention.
Figure 6B:
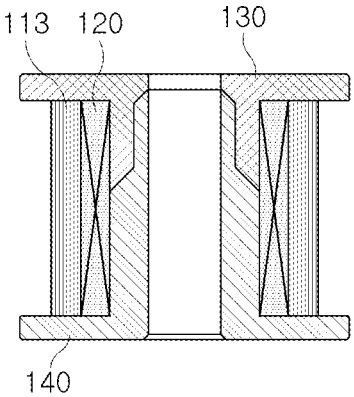
Figure 6C:
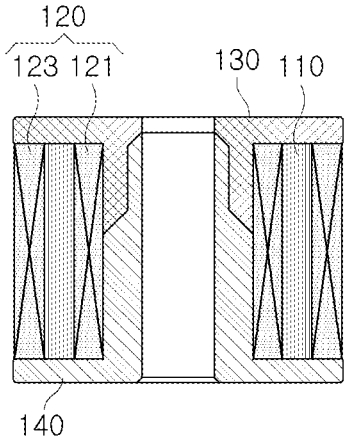
Figure 7:
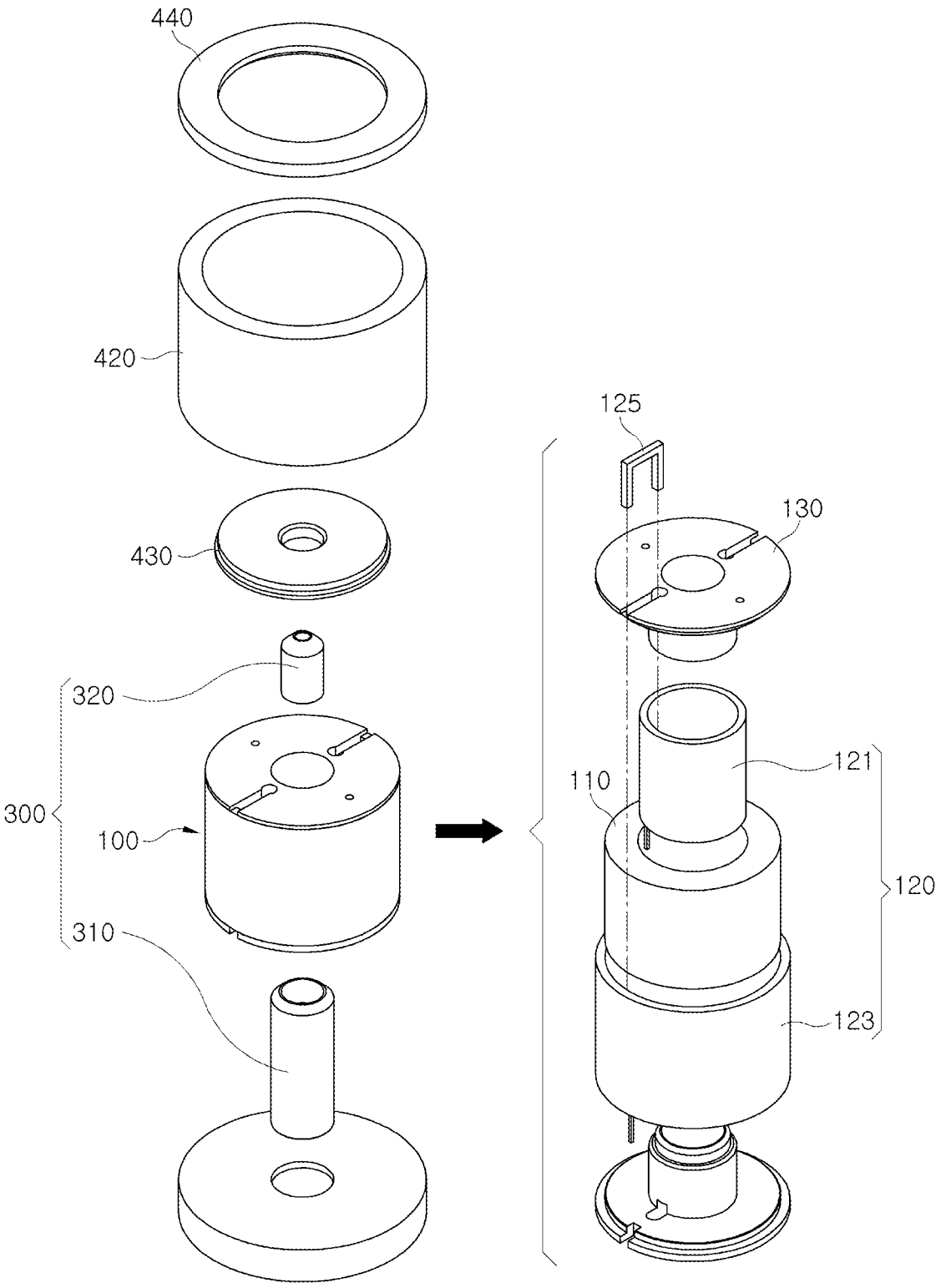
FIG. 7 is an exploded perspective view roughly showing electromagnet equipment according to a second embodiment of the present invention.
Figure 8:
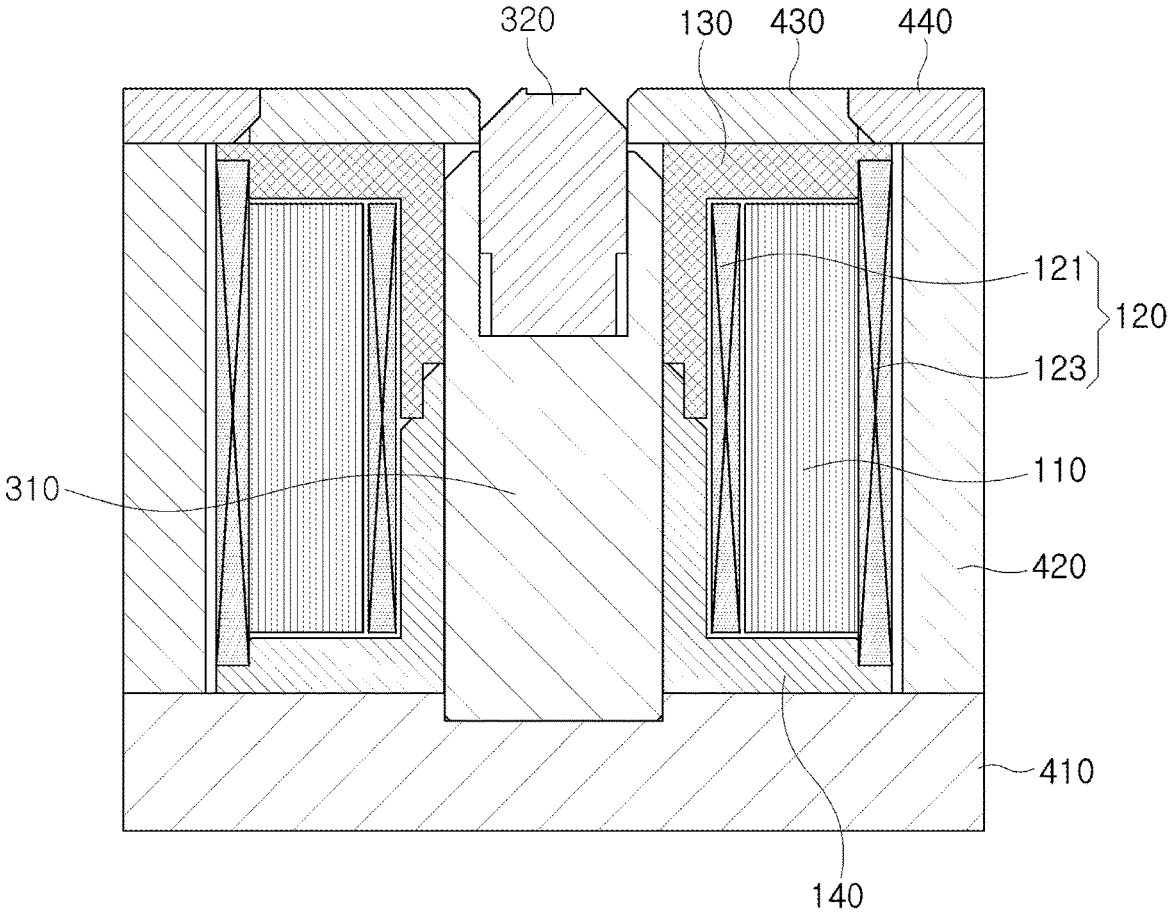
FIG. 8 is a side cross-sectional view roughly showing a side cross-section of the electromagnet equipment according to the second embodiment of the present invention.

FIGS. 1A to 1C are views roughly showing a bobbin of electromagnet equipment according to a first embodiment of the present invention, FIGS. 2A and 2B are side cross-sectional views roughly showing a side cross-section of the bobbin of the electromagnet equipment according to the first embodiment of the present invention, FIG. 3 is a perspective view roughly showing the electromagnet equipment according to the first embodiment of the present invention, FIG. 4 is an exploded perspective view roughly showing the electromagnet equipment according to the first embodiment of the present invention, FIG. 5 is a side cross-sectional view roughly showing a side cross-section of the electromagnet equipment according to the first embodiment of the present invention, FIGS. 6A to 6C are side cross-sectional views showing various arrangements of a coil and a cooler in a coil assembly of the electromagnet equipment according to the first embodiment of the present invention, FIG. 7 is an exploded perspective view roughly showing electromagnet equipment according to a second embodiment of the present invention, and FIG. 8 is a side cross-sectional view roughly showing a side cross-section of the electromagnet equipment according to the second embodiment of the present invention.

Hereinbelow, according to embodiments of the present invention, the bobbin, the coil assembly, and the electromagnet equipment will be described in order.

As shown in FIGS. 1A to 2B, the bobbin according to the first embodiment of the present invention can be used in the constitution of the electromagnet equipment as shown in FIGS. 3 to 8, and fundamentally provides a frame on which the coil can be wound. Furthermore, the bobbin can perform cooling and the condensation of magnetic field lines simultaneously. The bobbin includes a conduction part and a magnetic condensation part.

Preferably, the conduction part 130 is made of metal materials having high thermal conductivity for rapid cooling. Particularly, nonmagnetic metal materials having high thermal conductivity are preferred. Here, preferably, the thermal conductivity is 200 W/mK or more.

More preferably, the conduction part 130 is made of any one of aluminium and copper, or is made of an alloy material including at least any one of aluminium and copper.

Furthermore, as will be described hereinafter, the conduction part 130 receives heat transferred from a core pole 320 or a core rod body 310 of a core rod 300 so as to prevent the magnetization (or referred to as magnetic moment or magnetic flux density) of the core rod 300 from being decreased by heat. Additionally, the conduction part 130 prevents heat from being released to an upper side of the coil 110, thereby protecting a sample and improving the reliability of an experiment.

As shown in the drawings, the conduction part 130 includes a conducting shaft 131 provided at a center thereof, the conducting shaft 131 having a core hole 133. As will be described hereinafter, the core pole 320 or the core rod body 310 of the core rod 300 may be positioned on an inner side of the core hole 133, and the conduction part 130 rapidly transfers heat produced from the coil 110 to the cooler 120 so as to prevent the core pole 320 or the core rod body 310 of the core rod 300 and the magnetic condensation part 140 from overheating.

As will be described hereinafter, the conducting shaft 131 is combined with a condensation shaft 141 of the magnetic condensation part 140 so as to constitute a center shaft 150. The coil 110 is wound on the center shaft 150 constituted as described above relative to the center shaft 150.

The magnetic condensation part 140 may be combined with the conduction part 130 so as to constitute the bobbin, and is positioned on a lower side of the conduction part 130. The magnetic condensation part 140 condenses the magnetic field lines, and preferably, is made of ferromagnetic materials.

That is, it is also preferred that the magnetic condensation part 140 is made of any one of pure iron, cobalt, or nickel included in soft magnetic materials, or is made of an alloy material including at least any one of pure iron, cobalt, or nickel.

It is also possible to give a characteristic of a bias magnetic field to the magnetic condensation part 140 by using hard magnetic materials. To this end, as hard magnetic materials, aluminium, cobalt, nickel, copper, titanium, Sr, Ba, Fe, O, Sm, and Nd are used, or alloy materials including at least any one thereof, for example, AlNiCo, AlNiCoCuTi, SmCo, SrO.6Fe2O3, and BaO.6Fe2O3, etc. may be used.

In addition, preferably, the magnetic condensation part 140 is configured to decrease in width or diameter to an upper side end thereof from a lower side end thereof. For example, as shown in the drawings, the magnetic condensation part 140 is configured to decrease in diameter in three levels to the upper side end thereof from the lower side end thereof so as to condense the magnetic field lines or the magnetic field.

Furthermore, as mentioned roughly above, the magnetic condensation part 140 includes the condensation shaft 141 provided on the center thereof, and is combined with the conducting shaft 131 of the conduction part 130 so as to constitute the center shaft 150. Additionally, the condensation shaft 141 is preferred to include a core hole 143 or a core groove 145 provided on a center thereof.

As shown in FIG. 2A, when the condensation shaft 141 includes the core hole 143 provided at the center thereof, the core hole 143 may include the core rod body 310 arranged on an inner side thereof. Or, as shown in FIG. 2B, when the condensation shaft 141 includes the core groove 145, the core pole 320 is inserted into and combined with the core groove of the condensation shaft 141.

As shown in FIG. 2B, when the core rod body 310 is fused with the condensation shaft 141 and has the core groove 145 provided only on an upper side of the core rod body 310 so as to be combined with the core pole 320, there is no gap between the core rod body 310 and the condensation shaft 141. Accordingly, since the rise of magnetic resistance caused by a gap between the core rod body 310 and the condensation shaft 141 is restrained, magnetic loss may further be restrained.

Accordingly, preferably, the condensation shaft 141 includes the core hole 143 or the core groove 145 according to need.

Furthermore, it is preferred that the condensation shaft 141 is configured to decrease in width or diameter toward the upper side thereof for magnetic condensation.

Preferably, the condensation shaft 141 includes edge surfaces 146 provided on edges of upper sides thereof. Here, preferably, each of the edge surfaces 146 has an inclination angle of 5 to 85 degrees relative to a center axis of the condensation shaft 141. More preferably, each of the edge surfaces 146 has an inclination angle of 40 to 50 degrees relative to the center axis of the condensation shaft 141.

Since the condensation shaft 141 and the conducting shaft 131 are combined with each other so as to constitute the center shaft 150, each of the edge surfaces of the conducting shaft 131 is also preferred to have an inclination angle so as to be in contact with the edge surfaces 146 of the condensation shaft 141 corresponding thereto.

Meanwhile, preferably, the conduction part 130 or the magnetic condensation part 140 included in the bobbin includes a through hole or a through groove provided thereon so as to wind or withdraw a line of the coil on or from the center shaft 150. In addition, the conduction part 130 or the magnetic condensation part 140 is also preferred to include the through hole or the through groove provided thereon so as to withdraw a refrigerant tube connected to the cooler which may be arranged on a position neighboring the coil relative to the center shaft 150.

Accordingly, according to the first embodiment of the present invention, the bobbin can promote the efficiency of condensing the magnetic field lines.

Next, according to the embodiments of the present invention, the coil assembly 100 is configured to include the bobbin and the coil, and preferably, may further include the cooler 120.

The bobbin includes the center shaft 150 on which the coil 110 is wound relative thereto, and provides a frame which the coil 110 may be wound on and supported by. Since such a bobbin is the same as described above, further description thereof will be omitted.

The coil 110 is wound on the center shaft 150 of the bobbin relative thereto so as to form the magnetic field lines or the magnetic field by an electric current supplied from outside.

Here, the coil 110 may be a conventional conductor such as copper, and a line of the coil 110 is also preferred to include a through hole provided on an inner side thereof. In this case, while a refrigerant supplied from an outside moves through the through hole provided on the inner side of the line of the coil 110, the refrigerant can absorb and remove heat of the coil 110.

Preferably, when required, the coil having the through hole and a conventional coil may be used together.

That is, the coil having the through hole is relatively larger in a cross-sectional area of a line of the coil than the conventional coil. Accordingly, since it is difficult to increase the number of coil windings of a coil having the through hole, the conventional coil is used with the coil having the through hole so as to increase the number of windings and the density of electric current per unit area, whereby magnetic field efficiency is improved and cooling efficiency is increased.

When a line of the coil has no through hole, the coil assembly 100 is preferred to further include the cooler 120.

The cooler 120 fundamentally uses a refrigerant for cooling. Preferably, the cooler 120 also includes the refrigerant tube provided therein, wherein the refrigerant tube has a shape of a cylinder having a predetermined thickness and is made of metal materials having high thermal conductivity, the refrigerant flowing through the refrigerant tube, and like the coil 110, the refrigerant tube is also preferably wound on the center shaft 150 of the bobbin relative thereto.

Furthermore, preferably, a copper tube coated with an insulating paper or enamel as an insulator film and used as the cooler 120 is also arranged to have a shape wound in the way a coil is wound. When the copper tube coated with enamel is used as the cooler 120, the cooler 120 can obtain a cooling effect and function as an electric coil.

At least a portion of the cooler 120 is arranged to be in contact with an inner circumferential surface or an outer circumferential surface of the coil 110 wound on the center shaft 150 of the bobbin relative thereto, and the cooler 120 removes heat produced by an electric current running through the coil 110 by using the refrigerant supplied from outside.

According to the way in which the cooler 120 and the coil 110 are arranged on the bobbin, various embodiments are available.

That is, as shown roughly in FIG. 6A, the cooler 120 is arranged on an outer circumferential surface of a wound coil 111, and the cooler 120 is also preferred to cover the outer circumferential surface of the coil 111.

As shown in FIG. 6B, the cooler 120 is arranged between the coil 111 and the bobbin, and is also preferred to cover the inner circumferential surface of the coil 111.

As shown in FIGS. 4 and 5, the coil 110 may also be divided into the first coil 111 and a second coil 112 relative to the cooler 120.

That is, the coil 110 includes the first coil 111 and the second coil 112 with the cooler 120 therebetween, the first coil 111 being arranged to the core hole 133, 143 of the bobbin and the second coil 112 being arranged on an outer side of the cooler 120, and the first coil 111 is arranged on an inner side of the cooler 120 and the second coil 112 is arranged on an outer side of the cooler 120, and the cooler 120 is also preferably in contact with an outer side surface of the first coil 111 and an inner side surface of the second coil 112.

Here, the first coil 111 and the second coil 112 may be configured to be electrically connected to each other, and each may be configured to be independently provided with electric power by a terminal block 200.

In addition, the bobbin is preferred to include a hole or a groove provided between the first coil 111 and the second coil 112 so as to position a coil bridge 115, which is a line connecting the first coil 111 and the second coil 112 to each other. Additionally, the bobbin is also preferred to include a through hole or a through groove such that the line of the first coil 111 or the second coil 112 can be withdrawn to the terminal block 200.

As shown roughly in FIGS. 6C, 7, and 8, the cooler 120 includes a first cooler 121 and a second cooler 123, and a first cooler 121 is arranged between the coil 110 and the bobbin and thus the first cooler 121 covers the inner circumferential surface of the coil 110, and the second cooler 123 is arranged on the outer circumferential surface of the wound coil 110, and thus the second cooler 123 covers the outer circumferential surface of the coil 110. Accordingly, when the cooler 120 is arranged with the coil 110 arranged between the first cooler and the second cooler, the cooler 120 can cool the inner side and the outer side of the coil 110.

Furthermore, it is preferred that the bobbin includes the through hole or the through groove through which the refrigerant tube guiding the flow of the refrigerant by being connected to the first cooler 121 and the second cooler 123 can be connected to the terminal block.

Accordingly, the coil assembly 100 according to the embodiments of the present invention can promote the condensation efficiency of the magnetic field lines and the efficiency of cooling heat produced by an electric current running through the coil 110.

Next, according to the embodiments of the present invention, the electromagnet equipment will be described.

As shown FIGS. 1A to 6C, the electromagnet equipment according to the first embodiment of the present invention includes the coil assembly and the terminal block, and preferably, may include at least any one of the core rod, a ground yoke, a surrounding yoke and a radiation shield. Additionally, the electromagnet equipment may further include a protector capable of absorbing impacts caused by physical contacts with an outside.

In manufacturing the electromagnet equipment, the exposure of a portion of the coil 110 or the cooler 120 to the outside may make the electromagnet equipment aesthetically unpleasing. Accordingly, as shown FIGS. 1A to 1C, an upper end of the conduction part 130 and a lower end of the magnetic condensation part 140 are manufactured to include a first through hole 160 and a second through hole 170 respectively, which makes the electromagnet equipment neat in appearance. Each of the through holes allows uses such as the electrical connection of the first coil 111 with the second coil 112 or the connection of the first cooler 121 with the second cooler 123, etc. to be selected freely according to the arrangement of the coil 110 and the cooler 120.

In addition, the provision of a plurality of each of the first through hole 160 and the second through hole 170 can improve assembly convenience. The shapes of the through holes 160, 170 may be provided to have the shape of a circular hole, a slit, or a groove.

Here, as described above, the coil assembly 100 includes the bobbin and the coil. The coil 110 is wound on the center shaft 150 provided on a center of the bobbin relative thereto, and is provided with the refrigerant so as to remove heat produced due to the magnetic field lines formed by an electric current running through the coil 110.

As described above, the coil assembly 100 includes the cooler 120 provided between the first coil 111 and the second coil 112 as shown roughly in FIGS. 4 and 5, and preferably, the first coil 111 and the second coil 112 are electrically connected to each other by the coil bridge 115.

Furthermore, as shown FIGS. 7 and 8, preferably, the coil 110 is arranged between the first cooler 121 and the second cooler 123, and the refrigerant can flow between the first cooler 121 and the second cooler 123 via the cooler bridge 125. Since the coil assembly 100 is the same as described above, further description thereof will be omitted.

The terminal block 200 is positioned on a lower side of the coil assembly 100 and supports the coil assembly 100. The terminal block 200 is provided with a refrigerant such as a coolant from the outside so as to supply the refrigerant to the coil assembly 100.

The terminal block 200 includes a refrigerant inlet 210 for supplying the refrigerant and a refrigerant outlet 220 for releasing the refrigerant. The refrigerant inlet 210 and the refrigerant outlet 220 are connected to the cooler 120 in the coil assembly 100 by the refrigerant tube, and the refrigerant introduced to the refrigerant inlet 210 is introduced through the refrigerant tube to the cooler 120. The refrigerant released from the cooler 120 flows through the refrigerant tube to the refrigerant outlet 220 and then is conveyed to the outside.

Meanwhile, though not shown, the terminal block 200 may also include a cooling plate provided on an upper side thereof, the cooling plate performing a cooling function by receiving the refrigerant. When the terminal block 200 includes the cooling plate provided on the upper side thereof, the cooling plate can cool a ground yoke 410 or the magnetic condensation part 140 of the bobbin.

Furthermore, the ground yoke 410 may include at least one through hole 450 provided on any position thereof. The through hole 450 is connected to the second through hole 170 head-on, which functions as a passage by which lower ends of the coil 110 and the cooler 120 are connected to the terminal block 200.

In addition, the terminal block 200 includes an electric terminal 500 provided thereon so as to be electrically connected to the coil 110 of the coil assembly 100. An electric current from the outside runs to the coil 110 via the electric terminal.

Furthermore, though not shown, preferably, there is also provided the protector covering at least a portion of at least any one of a radiation shield and the surrounding yoke and absorbing impacts caused by physical contacts with the outside. A buffer bumper may be an example of the protector.

The protector as the buffer bumper which performs a protecting function by absorbing impacts from the outside covers at least any one part of an upper surface and an outer circumferential surface of the surrounding yoke, and may further cover a portion of the radiation shield. In addition, the thickness of the protector as the buffer bumper is 1 mm or more, and materials of the protector are preferably a high density sponge or Teflon, etc., which can absorb impacts.

As mentioned above, preferably, the coil assembly 100 includes the core hole 133, 143 or the core groove 145 provided on the inner side of the center shaft 150 of the bobbin thereof. In this case, preferably, there is also provided the core rod 300 which is inserted into the core hole 133, 143 or the core groove 145 and condenses the magnetic field lines formed by an electric current running through the coil 110.

The core rod 300 is preferably a single member, and is also preferred to include the core pole 320 and the core rod body 310.

In addition, preferably, the core rod 300 becomes equal or narrower in width to the upper side thereof from the lower side thereof, or the core pole 320 or the core rod body 310 becomes equal or narrower in width to the upper side thereof from the lower side thereof.

The core pole 320 is preferably made of materials having high permeability values such that the magnetic field lines are saturated. For example, a material of the core pole 320 is preferably iron, cobalt or zinc, or an alloy material including at least any one thereof. Accordingly, the core pole 320 is preferably made of materials which are great in total magnetic flux amount per unit area.

As a reference, as shown in FIGS. 6B, 6C, and 8, the provision of the first cooler 121 being in contact with the center shaft 150 of the bobbin allows heat produced from the core rod 300 to be cooled, thereby increasing heat insulation effect so as to prevent heat produced from the coil 110 from transferring to the core rod 300.

The ground yoke 410 is positioned between the coil assembly 100 and the terminal block 200 and supports the coil assembly 100.

Preferably, the ground yoke 410 includes the through hole or a through groove arranged thereon such that a refrigerant tube guiding the flow of the refrigerant or a line of the coil passes through the ground yoke via the through hole or the through groove and is connected to the terminal block.

Preferably, the lower side end of the core rod 300 is combined with and supported by the ground yoke 410. To this end, the ground yoke 410 includes a groove provided on a center thereof, wherein a portion of the core rod 300 may be inserted into and fixed to the groove.

The radiation shield 430 is positioned on an upper side of the coil assembly 100 so as to cover at least a portion of an upper side end of the coil assembly 100. Additionally, the radiation shield 430 prevents heat produced from the coil assembly 100 from being released to outside.

Particularly, the radiation shield 430 prevents heat produced from the coil assembly 100 from transferring to a measurement sample so as to protect the measurement sample, thereby improving the reliability of an experiment on the measurement sample.

The surrounding yoke 420 covers at least a portion of the radiation shield 430 or an outer circumferential surface of the coil assembly 100, and guides such that the magnetic field lines produced from the coil assembly 100 can be condensed to the core rod 300.

Furthermore, a covering 440 is combined with an upper side of the surrounding yoke 420 or with the radiation shield 430 so as to hold the radiation shield 430 such that the radiation shield 430 is safely positioned on the upper side of the coil assembly 100.

Accordingly, the electromagnet equipment according to the embodiments of the present invention can promote the condensation efficiency of the magnetic field lines and the efficiency of cooling heat produced by an electric current running through the coil.

As described above, according to the embodiments of the present invention, the bobbin and the coil assembly and the electromagnet equipment including the same can cool the coil assembly directly, thereby increasing cooling efficiency, the number of coil windings, and an allowable electric current compared to a conventional electromagnet and thus improving the magnetic field efficiency.

Furthermore, the characteristic structure of the bobbin enables the condensation of the magnetic field, thereby increasing the magnetic field efficiency and the saturation amount of magnetic flux.

In addition, the buffer bumper is further provided to prevent accidents.

Additionally, a portion of the coil and the cooler is not exposed to the outside, whereby a neat appearance can be maintained.

As described above, through detailed description of the present invention is made with embodiments referring to the accompanying drawings, the embodiments described in detail are just exemplary embodiments of the present invention, and the present invention should not be understood to be limited only to the embodiments, but the scope of the claims of the present invention should be understood to be the claims described hereinafter and concepts corresponding thereto.

What is claimed is:

1. Electromagnet equipment including a bobbin and a coil, the electromagnet equipment comprising:

a coil assembly receiving a refrigerant so as to remove heat produced when magnetic field lines are formed by an electric current running through the coil while the coil is wound on a center shaft relative to the center shaft provided on a center of the bobbin;

a terminal block provided on a lower side of the coil assembly, the terminal block supporting the coil assembly and receiving a refrigerant from outside and supplying the refrigerant to the coil assembly; and a core rod being inserted into a core hole or a core groove and being magnetized by the electric current running through the coil so as to form the magnetic field lines, wherein the coil assembly includes the core hole or the core groove provided on the center shaft of the bobbin thereof.

2. The electromagnet equipment of claim 1, wherein the core rod includes a core pole, an upper side end of which is exposed through the core hole or the core groove to an outside, and condensing the magnetic field lines; and a core rod body provided on a lower side of the core pole and supporting the core pole.

3. The electromagnet equipment of claim 1, wherein the core rod becomes equal or narrower in width to an upper side thereof from a lower side thereof.

4. The electromagnet equipment of claim 1, further comprising: a ground yoke provided between the coil assembly and the terminal block so as to support the coil assembly.

5. The electromagnet equipment of claim 4, wherein the ground yoke includes a through hole or a through groove arranged thereon such that a refrigerant tube guiding the flow of the refrigerant or a line of the coil passes through the ground yoke via the through hole or the through groove and is connected to the terminal block.

6. The electromagnet equipment of claim 4, wherein a lower side end of the core rod is combined with and supported by the ground yoke.

7. The electromagnet equipment of claim 1, further comprising:

a radiation shield provided on an upper side of the coil assembly so as to cover at least a portion of an upper side end of the coil assembly and to prevent heat produced from the coil assembly from being released to outside.

8. The electromagnet equipment of claim 7, further comprising:

a surrounding yoke covering at least a portion of the radiation shield or an outer circumferential surface of the coil assembly and guiding such that the magnetic field lines produced from the coil assembly can be condensed to a core rod.

9. The electromagnet equipment of claim 8, further comprising:

a protector covering at least a portion of at least any one of the radiation shield and the surrounding yoke and absorbing impacts caused by physical contacts from outside.

10. A coil assembly comprising:

a coil wound so as to form magnetic field lines by using an electric current supplied from an outside;

a bobbin provided with a center shaft on which the coil is wound relative thereto, wherein a line of the coil includes a through hole provided on an inner side thereof so as to enable flow of a refrigerant supplied from outside; and a core rod being inserted into a core hole or a core groove and being magnetized by the electric current running through the coil so as to form the magnetic field lines, wherein the coil assembly includes the core hole or the core groove provided on the center shaft of the bobbin thereof.

11. A coil assembly comprising:

a coil wound so as to form magnetic field lines by using an electric current supplied from outside;

a bobbin provided with a center shaft on which the coil is wound relative thereto;

a cooler arranged such that at least a portion of the cooler is in contact with an inner circumferential surface or an outer circumferential surface of the coil wound relative to the center shaft of the bobbin, the cooler removing heat produced by an electric current running through the coil by using a refrigerant supplied from outside; and a core rod being inserted into a core hole or a core groove and being magnetized by the electric current running through the coil so as to form the magnetic field lines, wherein the coil assembly includes the core hole or the core groove provided on the center shaft of the bobbin thereof.

12. The coil assembly of claim 11, wherein the cooler is arranged between the coil and the bobbin and covers the inner circumferential surface of the coil.

13. The coil assembly of claim 11, wherein the cooler is arranged on the outer circumferential surface of the wound coil and covers the outer circumferential surface of the coil.

14. The coil assembly of claim 11, wherein the coil includes a first coil arranged to a core hole of the bobbin and a second coil arranged on an outer side of the cooler, with the cooler provided therebetween, wherein the first coil is arranged on an inner side of the cooler and the second coil is arranged on the outer side of the cooler, the cooler being in contact with an outer side surface of the first coil and an inner side surface of the second coil.

15. The coil assembly of claim 11, wherein the bobbin includes a through hole or a through groove through which a refrigerant tube guiding the flow of the refrigerant by being connected to the cooler or a line of the coil passes through the bobbin and is connected to a terminal block.

16. A bobbin for electromagnet equipment, the bobbin comprising:

a conduction part made of metal materials having high thermal conductivity; and a magnetic condensation part provided on a lower side of the conduction part by being combined with the conduction part, the magnetic condensation part being made of a ferromagnetic material.

17. The bobbin of claim 16, wherein the conduction part, made of metal materials having high thermal conductivity, is a nonmagnetic substance.

18. The bobbin of claim 17, wherein the conduction part is an alloy material including any one of aluminium and copper.

19. The bobbin of claim 16, wherein the conduction part includes a conducting shaft provided on a center thereof, the conducting shaft having a core hole, and wherein the magnetic condensation part includes a condensation shaft provided on a center thereof, the condensation shaft having the core hole or a core groove, the conducting shaft of the conduction part and the condensation shaft of the magnetic condensation part being combined with each other so as to constitute a center shaft on which a coil is wound relative thereto.

20. The bobbin of claim 19, wherein the condensation shaft of the magnetic condensation part becomes narrower in width toward an upper side thereof.

21. The bobbin of claim 20, wherein an edge provided on the upper side of the condensation shaft has an inclination angle of 5 to 85 degree relative to a center axis of the condensation shaft.

22. Electromagnet equipment including a bobbin and a coil, the electromagnet equipment comprising:

a coil assembly receiving a refrigerant so as to remove heat produced when magnetic field lines are formed by an electric current running through the coil while the coil is wound on a center shaft relative to the center shaft provided on a center of the bobbin;

a terminal block provided on a lower side of the coil assembly, the terminal block supporting the coil assembly and receiving a refrigerant from outside and supplying the refrigerant to the coil assembly; and a radiation shield provided on an upper side of the coil assembly so as to cover at least a portion of an upper side end of the coil assembly and to prevent heat produced from the coil assembly from being released to outside.

23. The electromagnet equipment of claim 22, further comprising:

a surrounding yoke covering at least a portion of the radiation shield or an outer circumferential surface of the coil assembly and guiding such that the magnetic field lines produced from the coil assembly can be condensed to a core rod.

24. The electromagnet equipment of claim 23, further comprising:

a protector covering at least a portion of at least any one of the radiation shield and the surrounding yoke and absorbing impacts caused by physical contacts from outside.

* * * * *